United States Patent [19]

Lehmann

[11] Patent Number: 5,052,154

[45] Date of Patent: Oct. 1, 1991

[54] GRINDING WHEEL HAVING ADJUSTABLE AXIAL DIMENSION

[75] Inventor: Dieter Lehmann, Dreieich, Fed. Rep. of Germany

[73] Assignee: Naxos-Union Schleifmittel- u. Schleifmaschinenfabrik, Frankfurt, Fed. Rep. of Germany

[21] Appl. No.: 382,293

[22] Filed: Jul. 20, 1989

[30] Foreign Application Priority Data

Jul. 20, 1988 [DE] Fed. Rep. of Germany ..... 3824543

[51] Int. Cl.[5] ..... B34D 5/06

[52] U.S. Cl. ..... 51/206.4; 51/206 P

[58] Field of Search ..... 51/206 R, 206 P, 206.4, 51/206.5, 206 NF, 204, 205 WG; 125/15

[56] References Cited

U.S. PATENT DOCUMENTS

| | | | |
|---|---|---|---|
| 2,231,516 | 2/1941 | Wennberg | 51/209 |
| 2,646,653 | 7/1953 | Murchison | 51/206 R |
| 4,208,843 | 6/1980 | Amaki et al. | 51/206 R |

FOREIGN PATENT DOCUMENTS

| | | | |
|---|---|---|---|
| 290422 | 9/1913 | Fed. Rep. of Germany . | |
| 3605855A1 | 8/1987 | Fed. Rep. of Germany . | |
| 2061911 | 6/1971 | France . | |
| 60-48263 | 3/1985 | Japan . | |
| 0525540 | 11/1976 | U.S.S.R. | 51/206 R |
| 1087952 | 4/1965 | United Kingdom . | |

*Primary Examiner*—Robert A. Rose

*Attorney, Agent, or Firm*—Wenderoth, Lind & Ponack

[57] ABSTRACT

A grinding wheel includes a wheel supporting body and an abrasive material covering at least a circumferential surface of the wheel supporting body, radially outer portions of axially spaced side surfaces thereof and transitional areas between the circumferential and side surfaces. The wheel supporting body is formed of first and second partial bodies that are axially movable relative to each other. Each first and second partial body has on the outer periphery thereof a plurality of circumferentially spaced projections separated by respective axial grooves. The projections of each partial body fit within the grooves in the other partial body, such that the projections of the two bodies alternately mesh in a tooth-like manner and segmentally define the circumferential surface, the radially outer portions of the side surfaces and the transitional areas therebetween. The abrasive material is provided on the projections.

21 Claims, 3 Drawing Sheets

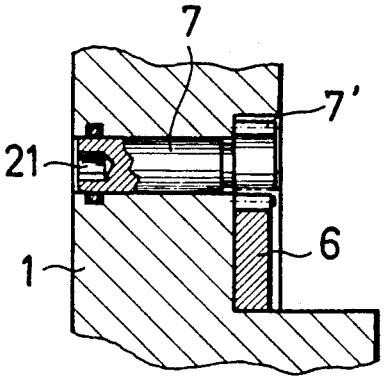
FIG. 3
FIG. 2
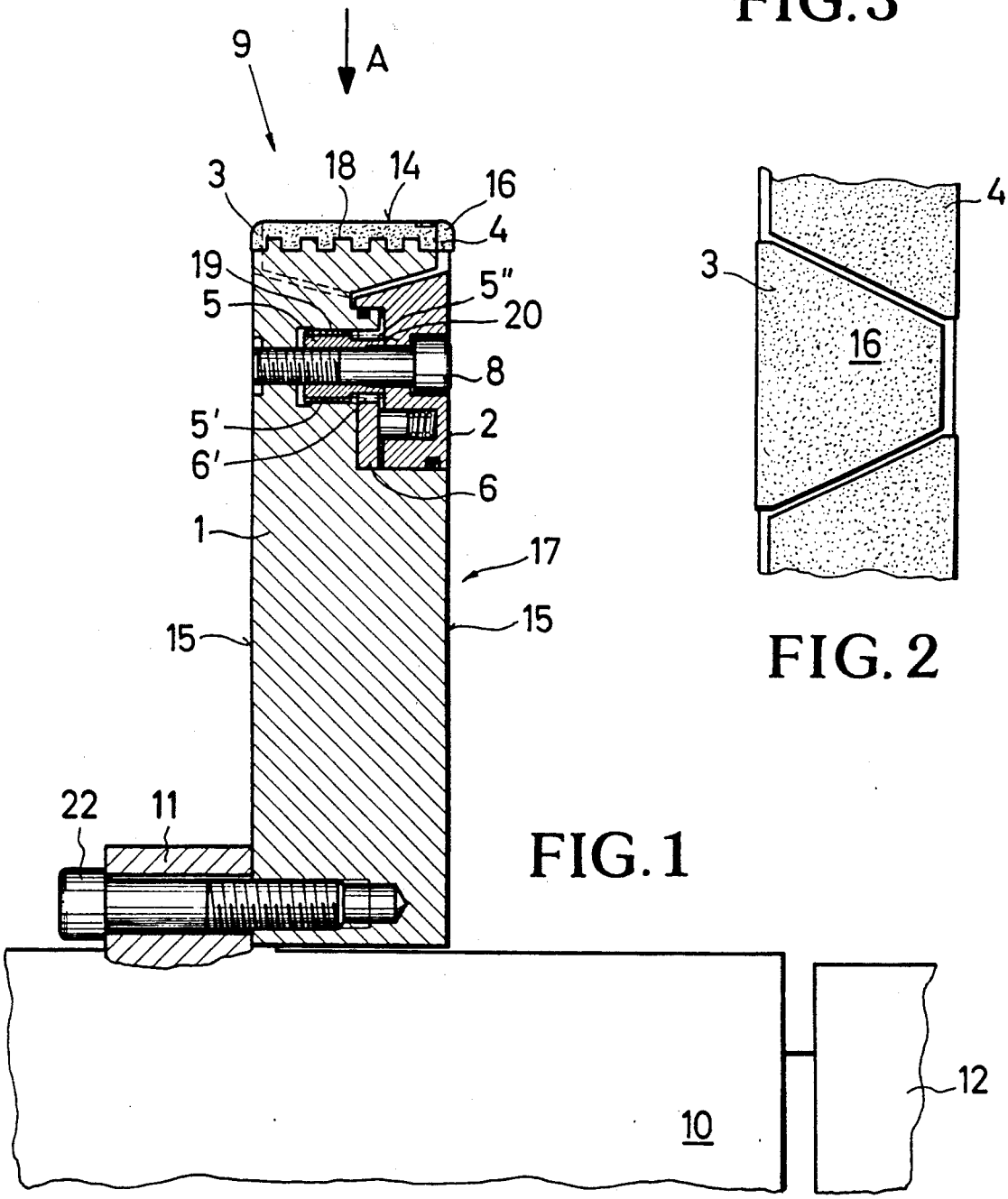
FIG. 1

GRINDING WHEEL HAVING ADJUSTABLE AXIAL DIMENSION

BACKGROUND OF THE INVENTION

The present invention relates to a grinding wheel having an adjustable axial dimension. Particularly, the present invention is directed to such a grinding wheel including a wheel supporting body and an abrasive material covering at least a circumferential surface of the wheel supporting body, radially outer portions of the axially spaced side or end surfaces, and transitional areas between such circumferential and side surfaces. Such abrasive material covering is of diamond, crystalline boron nitride (CBN) or a similar super-hard bound adhesive for grinding operations wherein stress is generated on or imparted to the side surfaces of the grinding wheel.

There are known various types of grinding operations wherein grinding is achieved not only by the circumferential surface of the grinding wheel or by inclined or beveled circumferential surfaces thereof, but also wherein grinding must be achieved by portions of the axially spaced side or end surfaces of the grinding wheel. A typical example is the grinding or placement of crank shafts for engines, wherein in addition to the ground surfaces necessary for fastening of connecting rods or to the ground surfaces for mounting the crank shaft in the engine block, there also must be achieved grinding on both sides of transitional radii and on both sides of bearing shoulders in directions of 90° to the axial direction or placement of the crank shaft. To achieve such side ground surfaces, the grinding wheel must have a precisely calibrated width, i.e. axial dimension. The side surfaces of the grinding wheel are strongly stressed during such side grinding operations, since the shoulder height must be cut in or ground as quickly as possible. The resultant abrasion on the transition points from the circumferential surface to the radially extending side surfaces of the grinding wheel therefore must be frequently replaced and renewed for grinding wheels formed conventionally totally of corundum or silicone carbide. This conventionally is achieved by strong trimming or dressing of the circumference of the grinding wheel. This however leads to a great waste of the abrasive material of the grinding wheel.

With super-hard grinding materials, for example diamond or cubic crystalline boron nitride (CBN), it is not necessary for the entire grinding wheel to be formed of the abrasive. Rather, a surface covering or layer of a few millimeters of the particular super-hard bound grinding material is applied to the circumferential surface of the wheel, i.e. specifically on a supporting body thereof, and to areas of the side surfaces of the wheel supporting body. This is achieved, and indeed necessary, for economic reasons due to the high cost of such high quality abrasive materials. However, this also is possible for technical reasons due to the fact that, based on past experience, a greater grinding capacity and a longer edge life is possible between trimming or dressing cycles when employing such harder abrasives. With diamond or CBN-layered grinding wheels, for example, the transitional edge area between the circumferential and side surfaces will have a service life of up to one thousand times greater between dressing or trimming operations than is possible with more conventional materials. Also, the dressing or trimming operations on the circumferential surface, when performed, amount to only a few μm. Thus, the wearability of this type of abrasive material can be limited to only a few millimeters.

However, there exists an unsolved problem with the use of this type of grinding wheel with a surface covering of a super-hard abrasive in a grinding operation with large stress applied to the side surfaces of the grinding wheel. Thus, since the dressing process on the surface of the grinding wheel amounts to only a few μm per treatment, the transition point between the circumferential surface and the side surfaces of the grinding wheel is not sufficiently renewed. The grinding wheel therefore essentially becomes narrower with every dressing or trimming operation. As a result, the accuracy of a side grinding operation is varied. For example, with the placement grinding discussed above for a crank shaft, the width of such side grinding operation is changed by an undesirable amount.

SUMMARY OF THE INVENTION

With the above discussion in mind, it is an object of the present invention to provide a grinding wheel whereby it is possible to overcome the above and other prior art disadvantages.

It is a more specific object of the present invention to provide an improved grinding wheel for use in grinding operations wherein high levels of stress are imparted to side abrasive surfaces of the wheel, but whereby it is possible to ensure that such side grinding operations are achieved with a desired and improved level of accuracy.

The above and other objects of the present invention are achieved by the provision that the wheel supporting body is formed of first and second partial bodies that are axially movable relative to each other. Each of the first and second partial bodies has on the outer periphery thereof a plurality of circumferentially spaced projections separated by respective axial grooves. The projections of each partial body fit within respective grooves in the other partial body, such that the projections of the two bodies alternately mesh in a tooth-like or claw-like manner and segmentally define the circumferential surface, the radially outer portions of the side surfaces, and the transitional areas therebetween of the wheel supporting body. The abrasive material is provided on such projections.

By the above structural features of the present invention it is possible to overcome the above and other prior art disadvantages in a simple manner by enabling the width or axial dimension of the grinding wheel to be adjusted as desired. Such adjustment is achieved, for example, upon wear of the side portions of the abrasive material or the transitional areas between the side surfaces and the circumferential surface. Thus, the required grinding surface is formed not just by the circumferential surface, but also by the side surfaces in such a manner that the partial wheel supporting bodies intermesh in a tooth-like manner on the outer circumference essentially over the entire width or axial dimension of the grinding wheel.

In order to provide a desired small joint spacing between the alternating tooth-like intermeshing projections of the partial bodies, the projections have a trapezoidal or triangular configuration as viewed radially toward the wheel. The longer edge of each triangle or trapezoid is on the exterior axial edge of the respective partial wheel supporting body. The projections of a first partial body are of a configuration substantially the mirror image of the configuration of the projections on the second partial body. By making the projections of the two partial bodies of substantially identical configuration, the outer surfaces that are used for grinding in the resultant grinding wheel are formed substantially symmetrically.

The abrasive material is diamond, crystalline boron nitride, or a similar super-hard bound abrasive suitable for grinding operations wherein stress is generated on the side surfaces of the grinding wheel. The abrasive material may be coated on the projections of the two partial bodies. Alternatively, the projections may be formed of the abrasive material. Yet further, it is possible for the grinding projections to be formed integrally with the respective partial bodies. However, in a particularly economical arrangement, the abrasive material is in the form of separate abrasive segments attached to the respective projections of the wheel supporting bodies. This may be achieved by cementing between the segments and the projections, particularly when the segments and projections have complementary engaging projections and grooves, for example as formed in a T-slot arrangement between the connecting surfaces. This provides not only a reliable and strong fit, but also enables replacement of the abrasive segments in a relatively easy manner.

In accordance with a particular feature of the present invention there is provided means for adjusting the relative axial spacing between the first and second partial bodies, and thereby for adjusting the axial dimension of the abrasive material of the grinding wheel. The adjusting means may be in the form of a plurality of adjustment members spaced circumferentially of the partial bodies, preferably at equal angular intervals, for example of 20°. The plural adjustment members are centered on a circle that is coaxial with the axis of the wheel. These features provide symmetrical adjustability while maintaining the required accuracy over the entire circumference of the grinding wheel.

In accordance with a particular feature of the present invention, each adjustment member comprises a cylindrical element having an exteriorly threaded portion in adjustable threaded engagement with a respective interiorly threaded opening or hole in the first partial body. A free forward end or surface of each adjustment member that is directed toward the second partial body forms an abutment portion to abut the second partial body and thereby to restrict displacement of the second partial body toward the first partial body. The adjustable threaded engagement between the cylindrical elements and the threaded holes in the first partial body are of a fineness or pitch to achieve the necessary accuracy in adjustment of the relative axial spacing between the first and second partial bodies.

Furthermore, each cylindrical element further includes a respective exterior toothed portion that is in meshing engagement with gear teeth extending circumferentially about a driving ring that is mounted concentrically relative to the two partial bodies to be movable circumferentially thereof. This arrangement provides the advantage that all of the cylindrical elements are threadably adjusted simultaneously by circumferential rotation of the driving ring relative to the partial bodies. This provides for uniform adjustment over the entire circumference.

There further is provided means mounted in at least one of the partial bodies for moving the driving ring in a selected circumferential direction relative to the partial bodies, to thereby cause the gear teeth of the driving ring to rotate the cylindrical elements relative to the first partial body, and thereby causing threaded adjustment of the cylindrical elements into or out of the threaded holes in the first partial body. Such moving means comprises at least one driving pinion (only one is necessary) rotatably mounted in the first partial body and having teeth in meshing engagement with the gear teeth of the driving ring. The driving pinion has on an end face thereof a tool engaging means, such as a slot or an irregular head, for enabling the driving pinion to be rotated, for example by a mating tool, thereby moving the driving ring circumferentially of the partial bodies.

In accordance with a further feature of the present invention, there is provided means for clamping together the first and second partial bodies at a selected axial spacing therebetween. Particularly, the cylindrical elements are hollow and have internal threads, and the clamping means comprise a plurality of bolts, each bolt extending through the second partial body and a respective cylindrical element and being threaded into the first partial body. Thus, after the cylindrical elements have been adjusted to provide a desired axial spacing between the two partial bodies, the bolts clamp the second partial body to the first partial body, with the second partial body abutting the free end abutment surfaces of the cylindrical elements. This abutment is achieved symmetrically around the entire circumference of the grinding wheel. By this compact and reliable arrangement it is possible for the two partial bodies to always be attached exactly at those positions at which the adjustment elements also act as spacers. This achieves a great degree of accuracy of adjustment of the width of the grinding wheel.

In accordance with a further feature of the present invention there is provided means for urging the driving ring in a direction axially away from the second partial body and toward the first partial body. Such urging means is in the form of a plurality of pins mounted in recesses in the second partial body and urged by respective springs from said recesses toward and into contact with the driving ring. This ensures that the driving ring always is urged in a circumferentially uniform manner toward the first partial body.

It also is possible in accordance with the present invention to tightly bolt the grinding wheel to a grinding spindle by means of a flange. Spindle carriers are provided on opposite axial sides of the flange of the grinding spindle. When changing a particular grinding wheel, the entire spindle unit is changed. With this structural feature the desired lateral run or beat does not change if, for example, the grinding machine is changed over to a different grinding wheel for another grinding operation.

BRIEF DESCRIPTION OF THE DRAWINGS

Other objects, features, advantages and possible uses of the present invention will be apparent from the following detailed description of a preferred embodiment thereof, with reference to the accompanying drawings, wherein:

FIG. 1 is a partial cross-sectional view of a portion of a grinding wheel according to the present invention;

FIG. 2 is a plan or elevation view taken in the direction of arrow A of FIG. 1;

FIG. 3 is an enlarged partial view of an adjustment drive of the grinding wheel;

DETAILED DESCRIPTION OF THE INVENTION

Figure 4:
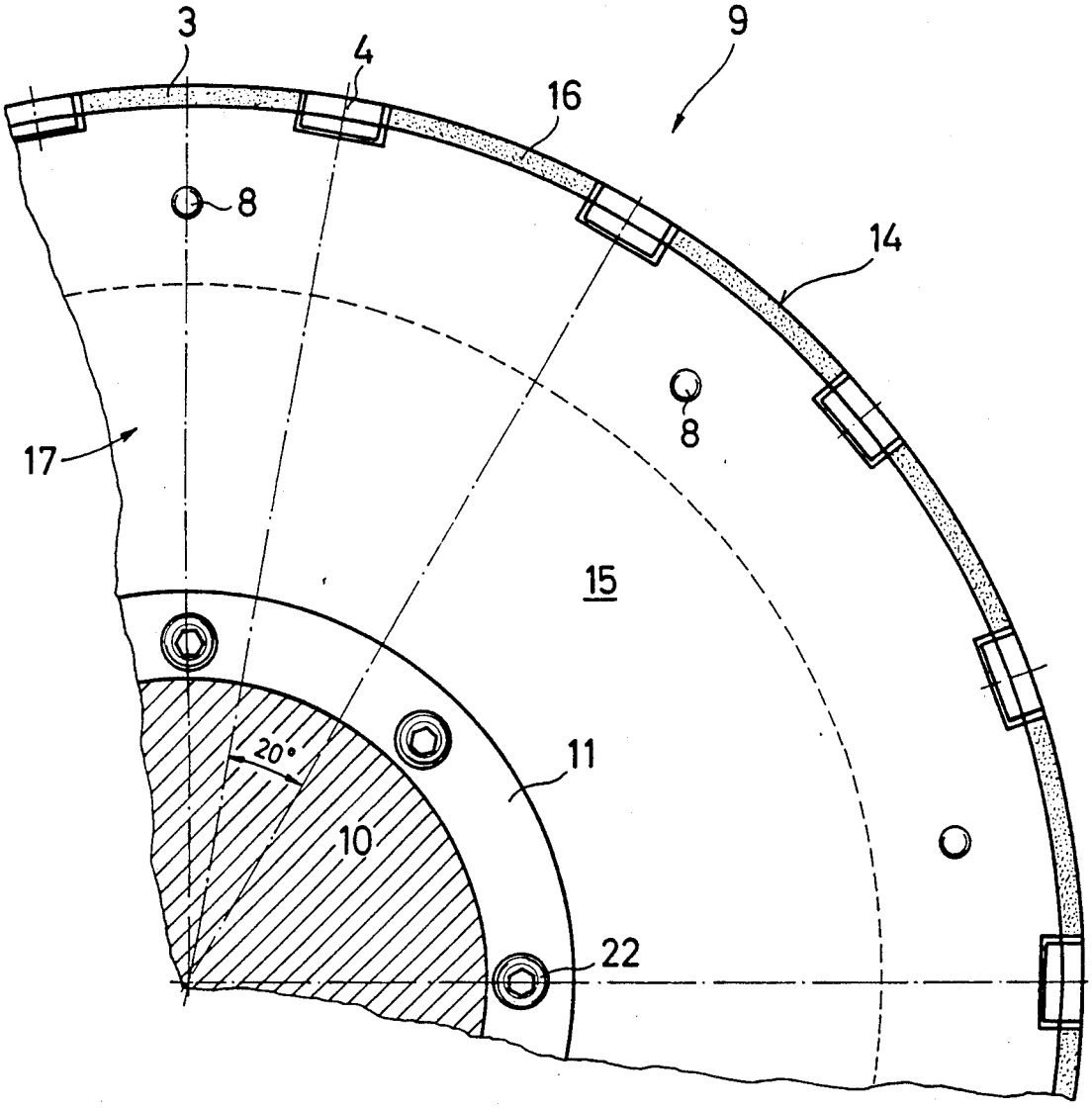
FIG. 4 is an end view, partially in section, of a portion of the grinding wheel of FIG. 1.

As shown in the drawings, a grinding wheel 9 of the present invention is intended for use in grinding operations wherein stress is imparted to side surfaces 15 of a wheel supporting body 17. The grinding wheel includes a covering 16 of adhesive material over the circumferential surface 14 of the wheel body, as well as on radially outer portions of the side surfaces 15 and in transitional areas between the circumferential and side surfaces. The abrasive covering 16 is intended to be of a few millimeters in thickness and is of a super-hard material such as diamond, crystalline boron nitride (CBN) or a similar super-hard bound adhesive.

In accordance with the present invention, the wheel supporting body 17 is divided into and formed by two wheel-like, preferably metal, partial wheel-supporting bodies 1, 2 that are axially adjustably movable relative to each other, i.e. toward or away from each other. Each of the first and second partial bodies 1, 2 has on the outer periphery thereof a plurality of circumferentially spaced projections separated by respective axial grooves (see particularly FIGS. 1, 2, 4, 5). The projections of each partial body fit within respective of the grooves in the other partial body, such that the projections of the two bodies alternately mesh in a tooth-like or claw-like manner and segmentally define the circumferential surface, the radially outer portions of the side surfaces, and the transitional areas therebetween of the grinding wheel. These relationships clearly are illustrated in the drawings.

The abrasive material is provided on the projections of the two partial bodies. In the particularly illustrated arrangement, the abrasive material is in the form of separate abrasive segments 3, 4 attached to the respective projections of the partial bodies 1, 2, respectively. The abrasive segments 3, 4 (preferably formed of a ceramically bound suitable super-hard abrasive material) are cemented to the respective projections of partial bodies 1, 2 over connecting surfaces 18. In the illustrated arrangement such surfaces are in the form of complementary engaging projections and grooves, in the manner of a T-slot arrangement. In this illustrated embodiment it is contemplated that partial bodies 1, 2 are formed of a suitable metal material. It would however also be possible for the abrasive material to be coated on the projections, or for the projections themselves to be formed of the abrasive material.

Figure 5:
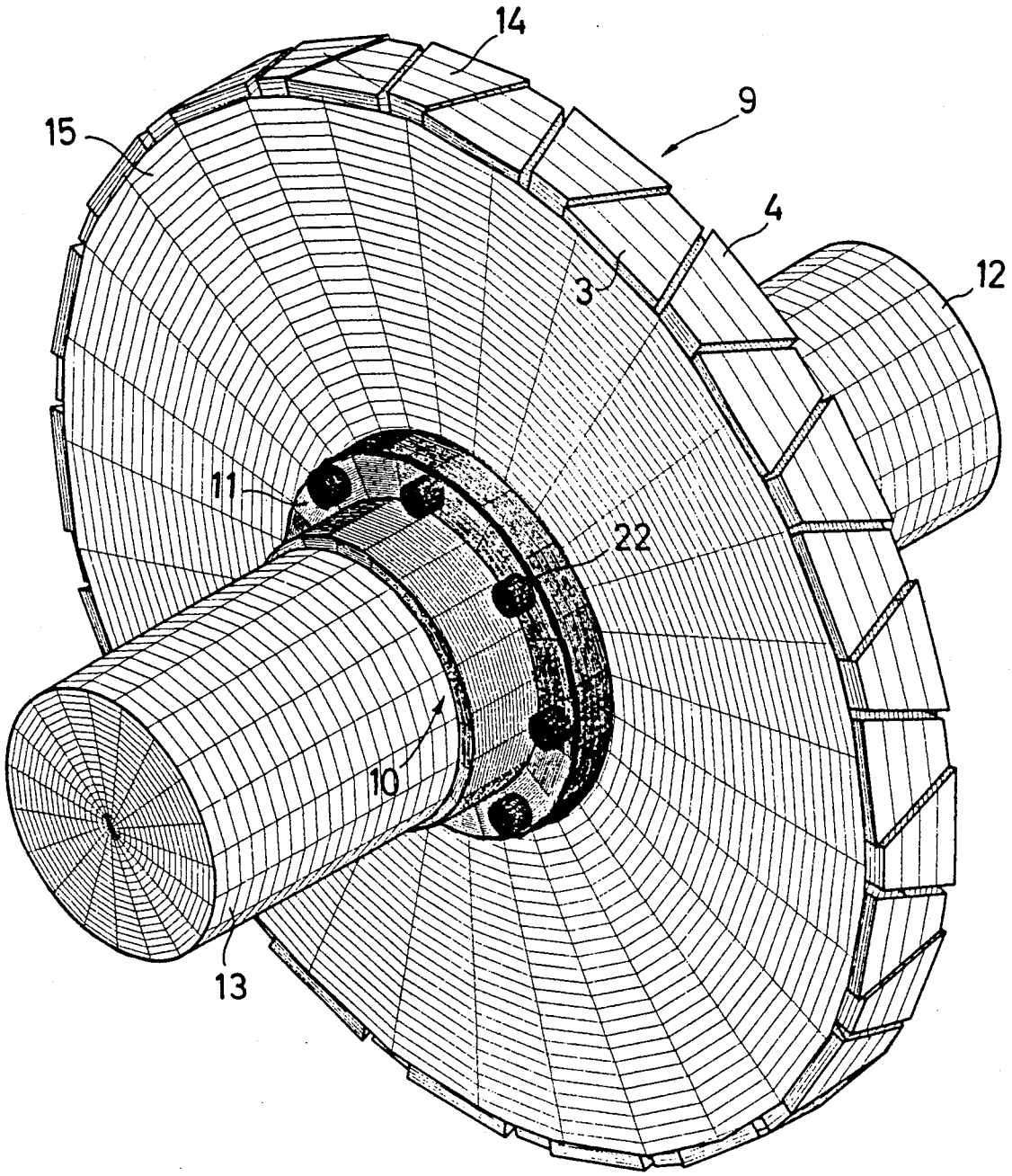
FIG. 5 is a perspective view, reflected in a model representation, of the grinding wheel of the present invention shown mounted on a grinding spindle with two lateral spindle carriers.

To provide a suitable relative spacing between the abrasive segments upon axial movement of the partial bodies 1, 2 toward or away from each other, the projections and abrasive segments are trapezoidal or triangular shaped, as shown particularly in FIGS. 1 and 5. Furthermore, the projections and segments of the two bodies are of substantial mirror image configuration, i.e. of substantially identical dimensions.

With particular reference to FIGS. 1 and 3 of the drawings, there will be described a particular means for selectively adjusting the relative axial spacing between the first and second partial bodies 1, 2, and thereby for adjusting the axial dimension of the abrasive material of the grinding wheel. Thus, there are provided a plurality of adjustment members in the form of cylindrical elements 5. Such cylindrical elements are spaced circumferentially of the grinding wheel at equal angular intervals, for example of 20°. All of the cylindrical elements 5 are centered on a circle that is coaxial with the axis of the wheel. Each cylindrical element 5 has an exteriorly threaded portion 5' in adjustably threaded engagement with a respective interiorly threaded hole 19 of first partial body 1. Each cylindrical element 5 further includes an abutment surface 20 on the free end thereof directed towards second partial body 2 to abut such second partial body and thereby to restrict displacement of second partial body 2 toward the first partial body 1.

Additionally, each cylindrical element 5 further includes a respective exterior toothed portion 5''. The teeth 5'' of all of the cylindrical elements 5 engage gear teeth 6' of a driving ring 6 that is mounted concentrically relative to the partial bodies 1, 2 to be movable circumferentially thereof.

There is provided means for moving driving ring 6 in a selected circumferential direction relative to the partial bodies, to thereby cause the gear teeth 6' of driving ring 6 to rotate the cylindrical elements 5 relative to the first partial body 1, and thereby causing threaded adjustment of the cylindrical elements 5 into or out of the threaded holes 19 and first partial body 1. As the cylindrical elements 5 are thus adjusted, abutment surfaces 20 define the relative spacing of second partial body 2 with respect to first partial body 1. With particular reference to FIG. 3, this moving means is in the form of a driving pinion 7 rotatably mounted in first partial body 1 and having teeth 7' in meshing engagement with gear teeth 6' of driving ring 6. The center axis of driving pinion 7 is located on the same circle that passes through the center axes of all of the cylindrical elements 5, thereby ensuring symmetrical movement of the various elements around the entire circumference of the grinding wheel. Driving pinion 7 has on an end face thereof tool engaging means, for example a slot 21, for enabling the driving pinion to be rotated, thereby moving driving ring 6 circumferentially of the partial bodies. It is only necessary to provide a single driving pinion 7, although a number of driving pinions could be provided.

There additionally is provided clamping structure for clamping the second partial body to the first partial body after a selected axial spacing therebetween has been determined. Thus, cylindrical elements 5 are hollow and have internal threads. A plurality of bolts 8 extend through the second partial body 2 and respective cylindrical elements 5 and are threaded into respective threaded holes in first partial body 1.

Additionally, as shown in FIG. 1 immediately below the bolt 8 shown therein, a plurality of pins are mounted in respective recesses in second partial body 2 and are urged by respective springs from such recesses toward driving ring 6. Only one such pin and spring are illustrated. By this arrangement, the springs urge the pins to abut driving ring 6, thereby constantly urging driving ring 6 toward first partial body 1. During circumferential movement of driving ring 6, driving ring 6 slides across the inner faces of the pins.

Thus, with bolts 8 loosened, pinion 7 may be rotated in the appropriate direction to cause rotation of driving ring 6 relative to the partial bodies. This causes simultaneous adjustment of all of the cylindrical elements 5 into or out of partial body 1. This defines a particular positioning of abutment surfaces 20 uniformly around the entire grinding wheel. During this adjustment, the spring biased pins maintain driving ring 6 toward first partial body 1. When the desired spacing adjustment is achieved, bolts 8 then may be tightened to clamp the second partial body 2 to the first partial body 1. Thereby the dimension of the abrasive segments in the axial dimension of the grinding wheel is adjusted to a precise value. This enables a precise grinding operation to be achieved, both by the circumferential surface 14 and by the side edges of the abrasive segments.

As will be apparent particularly from a consideration of FIGS. 1, 4 and 5, the entire grinding wheel 9 may be fastened securely by bolts 22 to a flange 11 of a grinding spindle 10 that has spindle carriers 12, 13 on opposite sides of grinding wheel 9 and flange 11. When changing the grinding wheel, the entire spindle unit is changed. Accordingly, when a grinding wheel of a grinding machine is changed to another grinding wheel for another grinding task, the lateral run or beat will not change.

Although the present invention has been described and illustrated with respect to preferred features, it is to be understood that various changes and modifications may be made to the specifically described and illustrated features without departing from the present invention.

I claim:

1. A grinding wheel including a wheel supporting body, and an abrasive material provided at least at a circumferential surface of said wheel supporting body, at radially outer portions of axially spaced side surfaces thereof and at transitional areas between said circumferential and side surfaces, wherein:

said wheel supporting body is formed of first and second partial bodies that are axially movable relative to each other;

each said first and second partial body has on the outer periphery thereof a plurality of circumferentially spaced projections separated by respective axial grooves;

said projections of each said partial body fit within respective ones of said grooves in the other said partial body, such that said projections of said two bodies alternately mesh in a tooth-like manner and segmentally define said circumferential surface, said radially outer portions of said side surfaces and said transitional areas therebetween;

said abrasive material is provided on said projections;

adjusting means are provided for adjusting the relative axial spacing between said first and second partial bodies, and thereby for adjusting the axial distance between said spaced side surfaces;

said adjusting means comprises a plurality of adjustment members spaced circumferentially of said partial bodies;

each said adjustment member has an exteriorly threaded portion in adjustably threaded engagement with a respective thread provided in said first partial body;

each said adjustment member further includes an abutment portion to abut said second partial body and thereby to restrict displacement of said second partial body toward said first partial body;

each said adjustment member further includes a respective exterior toothed portion; and a driving ring is provided and has gear teeth in meshing engagement with said exterior toothed portions of all of said adjustment members.

2. The improvement claimed in claim 1, wherein said abrasive material comprises diamond, crystalline boron nitride, or a similar super-hard bound abrasive suitable for grinding operations wherein stress is generated on said side surfaces.

3. The improvement claimed in claim 1, wherein said abrasive material is coated on said projections.

4. The improvement claimed in claim 1, wherein said projections are formed of said abrasive material.

5. The improvement claimed in claim 1, wherein said abrasive material is in the form of separate abrasive segments attached to respective said projections.

6. The improvement claimed in claim 5, wherein said projections and segments have complementary engaging projections and grooves.

7. The improvement claimed in claim 5, wherein said partial bodies are formed of metal.

8. The improvement claimed in claim 1, wherein said projections are of trapezoidal or triangular configuration, as viewed radially toward said wheel.

9. The improvement claimed in claim 1, wherein said projections of said first partial body are of a configuration substantially the mirror image of the configuration of said projections of said second partial body.

10. The improvement claimed in claim 1, wherein said adjustment members are spaced at equal angular intervals.

11. The improvement claimed in claim 1, wherein said adjustment members are centered on a circle coaxial with the axis of said wheel.

12. The improvement claimed in claim 1, wherein said driving ring is mounted concentrically relative to said partial bodies to be movable circumferentially thereof.

13. The improvement claimed in claim 12, further comprising means mounted in at least one of said partial bodies for moving said driving ring in a selected circumferential direction relative to said partial bodies, thereby causing said gear teeth of said driving ring to rotate said cylindrical elements relative to said first partial body, and thereby causing threaded adjustment of said cylindrical elements into or out of said holes in said first partial body.

14. The improvement claimed in claim 13, wherein said moving means comprises a driving pinion rotatably mounted in said first partial body and having teeth in meshing engagement with said gear teeth of said driving ring.

15. The improvement claimed in claim 14, wherein said driving pinion has on an end face thereof tool engaging means for enabling said driving pinion to be rotated, thereby moving said driving ring circumferentially of said partial bodies.

16. The improvement claimed in claim 1, further comprising means for clamping together said first and second partial bodies at a selected axial spacing therebetween.

17. The improvement claimed in claim 16, wherein each said adjustment member comprises a hollow cylindrical element, and said clamping means comprises a plurality of bolts, each said bolt extending through said second partial body and a respective one of said cylindrical elements and being threaded into said first partial body.

18. The improvement claimed in claim 1, further comprising means for urging said driving ring in a direction axially away from said second partial body and toward said first partial body.

19. The improvement claimed in claim 18, wherein said urging means comprises a plurality of pins mounted in recesses in said second partial body and urged by respective springs from said recesses toward said driving ring.

20. The improvement claimed in claim 1, further comprising a driving spindle having a radial flange, said first partial body being fixedly securable to said flange.

21. The improvement claimed in claim 20, further comprising spindle carriers provided on opposite axial sides of said flange.

* * * * *